US009464491B2

(12) United States Patent
Nikiforuk

(10) Patent No.: US 9,464,491 B2
(45) Date of Patent: Oct. 11, 2016

(54) SYSTEMS AND METHODS FOR TUBULAR ENGAGEMENT AND MANIPULATION

(71) Applicant: TESCO CORPORATION, Houston, TX (US)

(72) Inventor: Kevin James Nikiforuk, Houston, TX (US)

(73) Assignee: TESCO CORPORATION, Houston, TX (US)

( * ) Notice: Subject to any disclaimer, the term of this patent is extended or adjusted under 35 U.S.C. 154(b) by 237 days.

(21) Appl. No.: 14/200,936

(22) Filed: Mar. 7, 2014

(65) Prior Publication Data

US 2014/0262336 A1 Sep. 18, 2014

Related U.S. Application Data

(60) Provisional application No. 61/790,774, filed on Mar. 15, 2013.

(51) Int. Cl.

| | |
|---|---|
| ***E21B 19/16*** | (2006.01) |
| ***E21B 19/06*** | (2006.01) |
| ***E21B 19/14*** | (2006.01) |
| ***E21B 3/02*** | (2006.01) |

(52) U.S. Cl.
CPC ..... *E21B 19/06* (2013.01); *E21B 3/02* (2013.01); *E21B 19/14* (2013.01); *E21B 19/16* (2013.01)

(58) Field of Classification Search
CPC ..... E21B 19/06; E21B 19/10
See application file for complete search history.

(56) References Cited

U.S. PATENT DOCUMENTS

| | | | |
|---|---|---|---|
| 3,774,697 | A | 11/1973 | Brown |
| 4,890,681 | A | 1/1990 | Skelly |
| 6,527,047 | B1 | 3/2003 | Pietras |
| 2010/0183418 | A1 | 7/2010 | Henderson et al. |
| 2011/0147010 | A1* | 6/2011 | Ellis ..... E21B 19/07 166/380 |

OTHER PUBLICATIONS

Cooper, Brian S. et al., "Reaming with Casing and Rotating While Cementing," TESCO Corporation, American Associate of Drilling Engineers, presented at the AADE National Technical Conference and Exhibition in Houston, Texas, Apr. 12-14, 2011.
Invitation to Pay Additional Fees and, Where Applicable, Protest Fee for International Application No. PCT/US2014/022759 mailed Feb. 2, 2015.

* cited by examiner

*Primary Examiner* — Giovanna C Wright
*Assistant Examiner* — Manuel C Portocarrero
(74) *Attorney, Agent, or Firm* — Fletcher Yoder, P.C.

(57) ABSTRACT

A system for manipulating a tubular about a drilling rig is provided. The system includes a swivel body rotatably coupled with a becket. The becket is configured to couple with a traveling block of the drilling rig. The system also includes an engagement feature rotatably coupled with the swivel body. The engagement feature is configured to be actuated to engage the tubular. In addition, the system includes a tilt mechanism configured to be actuated to transition the swivel body and the engagement feature between a tilted orientation and an upright orientation relative to the becket. Further, the system includes an actuator system configured to actuate the tilt mechanism and the engagement feature.

11 Claims, 8 Drawing Sheets

SYSTEMS AND METHODS FOR TUBULAR ENGAGEMENT AND MANIPULATION

CROSS-REFERENCE TO RELATED APPLICATIONS

This application claims priority from and the benefit of U.S. Provisional Application Ser. No. 61/790,774, entitled "Systems and Methods for Tubular Engagement and Manipulation," filed Mar. 15, 2013, which is hereby incorporated by reference in its entirety.

BACKGROUND

Embodiments of the present disclosure relate generally to the field of drilling and processing of wells. More particularly, present embodiments relate to systems and methods for engaging and manipulating tubulars on a drilling rig.

In conventional oil and gas operations, a well is typically drilled to a desired depth with a drill string, which includes drillpipe, drill collars and a bottom hole drilling assembly. Certain drilling rigs, including many that handle lighter duty operations, are equipped with a Kelly drive. On such rigs, the drill string may be rotated via the Kelly drive located at the rig floor, which turns a Kelly pipe coupled to a tubular of the drill string. The upper tubular of the drill string may be rotatably coupled to and supported by a swivel, which is suspended from a traveling block above the rig floor so that it may be raised and lowered throughout the drilling operations. The swivel typically includes a becket, which hangs from a hook of the traveling block, as well as an engagement feature for engaging a tubular element.

In conventional operations, new lengths of tubular may be added to the drill string using the swivel. Specifically, the swivel may be positioned near the new length of tubular, coupled to the tubular via the engagement feature, and hoisted to move the tubular from its initial position to a position above the drill string prior to stabbing the tubular into the top of the drill string. This process often involves a human operator connecting the tubular to the engagement feature of the swivel. In addition, the human operator may tilt elevators or the swivel itself relative to the vertically hanging becket to facilitate retrieval of the tubular. Unfortunately, the lack of automation in this tubular retrieval and manipulation process can lead to inefficient rig operations.

The engagement feature may be designed to engage an internal or external portion of the tubular in order to transfer torque between the tubular and the engagement feature. External engagement features may be particularly appropriate for coupling with smaller diameter tubular, such as those used on lighter duty rigs or rigs equipped with Kelly drives. Unfortunately, such engagement features may be limited in certain contexts. For example, it may be difficult to circulate pressurized drilling fluid through a tubular element that is gripped via an external engagement feature.

Accordingly, it is now recognized that there exists a need for improved systems to engage and manipulate tubular on various types of drilling rigs.

BRIEF DESCRIPTION

Present embodiments are designed to respond to such a need. In accordance with one aspect of the disclosed embodiments, a system for manipulating a tubular about a drilling rig is provided. The system includes a swivel body rotatably coupled with a becket. The becket is configured to couple with a traveling block of the drilling rig. The system also includes an engagement feature rotatably coupled with the swivel body. The engagement feature is configured to be actuated to engage the tubular. In addition, the system includes a tilt mechanism configured to be actuated to transition the swivel body and the engagement feature between a tilted orientation and an upright orientation relative to the becket. Further, the system includes an actuator system configured to actuate the tilt mechanism and the engagement feature.

In accordance with another aspect of the disclosed embodiments, a drilling system includes a housing of an external tubular engagement feature and a seat of the housing configured to receive a distal end of a tubular. The drilling system also includes a gripping mechanism of the external tubular engagement feature. The gripping mechanism is configured to be actuated to grip an external surface of the tubular. In addition, the drilling system includes a sealing mechanism of the engagement feature positioned between the seat and the gripping mechanism. The sealing mechanism is configured to be actuated to create a seal against the external surface of the tubular. Further, the drilling system includes a mechanical assembly of the engagement feature. The mechanical assembly is coupled to the gripping mechanism and the sealing mechanism and configured to mechanically actuate the gripping mechanism and the sealing mechanism.

Present embodiments also provide a method for manipulating a tubular about a drilling rig. The method includes tilting, via a tilt mechanism, a swivel body and an engagement feature from an upright orientation to a tilted orientation relative to a becket. The swivel body is rotatably coupled with the becket and the engagement feature is rotatably coupled with the swivel body. The method also includes engaging the tubular via the engagement feature. In addition, the method includes actuating the tilt mechanism and the engagement feature via an actuator system.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Presently disclosed embodiments are directed toward novel systems and methods for engaging and manipulating tubular (e.g., drill pipe, casing, etc.). The systems may be used on any type of drilling rig, including those equipped with a Kelly drive that rotates the tubular by applying a torque at the rig floor. In addition, the systems may be capable of engaging and circulating fluid through tubular of any desired size.

Current systems for manipulating tubular on a Kelly rig rely on a human operator stationed at the mast or another part of the rig to help an engagement feature of the swivel engage (e.g., couple with) a new length of tubular. The disclosed embodiments include a system for manipulating tubular about a drilling rig equipped with a Kelly drive. The system includes a swivel hanging from a becket, which hangs from a traveling block of the drilling rig. The system can rotate the swivel relative to the becket in order to engage tubular. Once engaged, the tubular may be moved about the drilling rig. The becket may remain properly oriented in a vertical direction as the swivel and the engaged tubular are rotated relative to the becket. To accomplish this rotation, the system is equipped with a tilt mechanism that, when actuated, transitions the swivel and an engagement feature between a tilted orientation and an upright orientation relative to the becket. These functions may be performed with minimal or no human interaction to move a new length of tubular about the drilling rig.

In addition to a system for manipulating the tubular, the disclosed embodiments may include an external engagement feature to engage an outer diameter of the tubular. This external engagement feature may be used in the swivel system disclosed above, to allow the manipulation of a relatively smaller diameter tubular. The external engagement feature may grip the outer diameter of the tubular and provide a seal of the outer diameter so that fluid may be circulated through the tubular while it is engaged.

Figure 1:
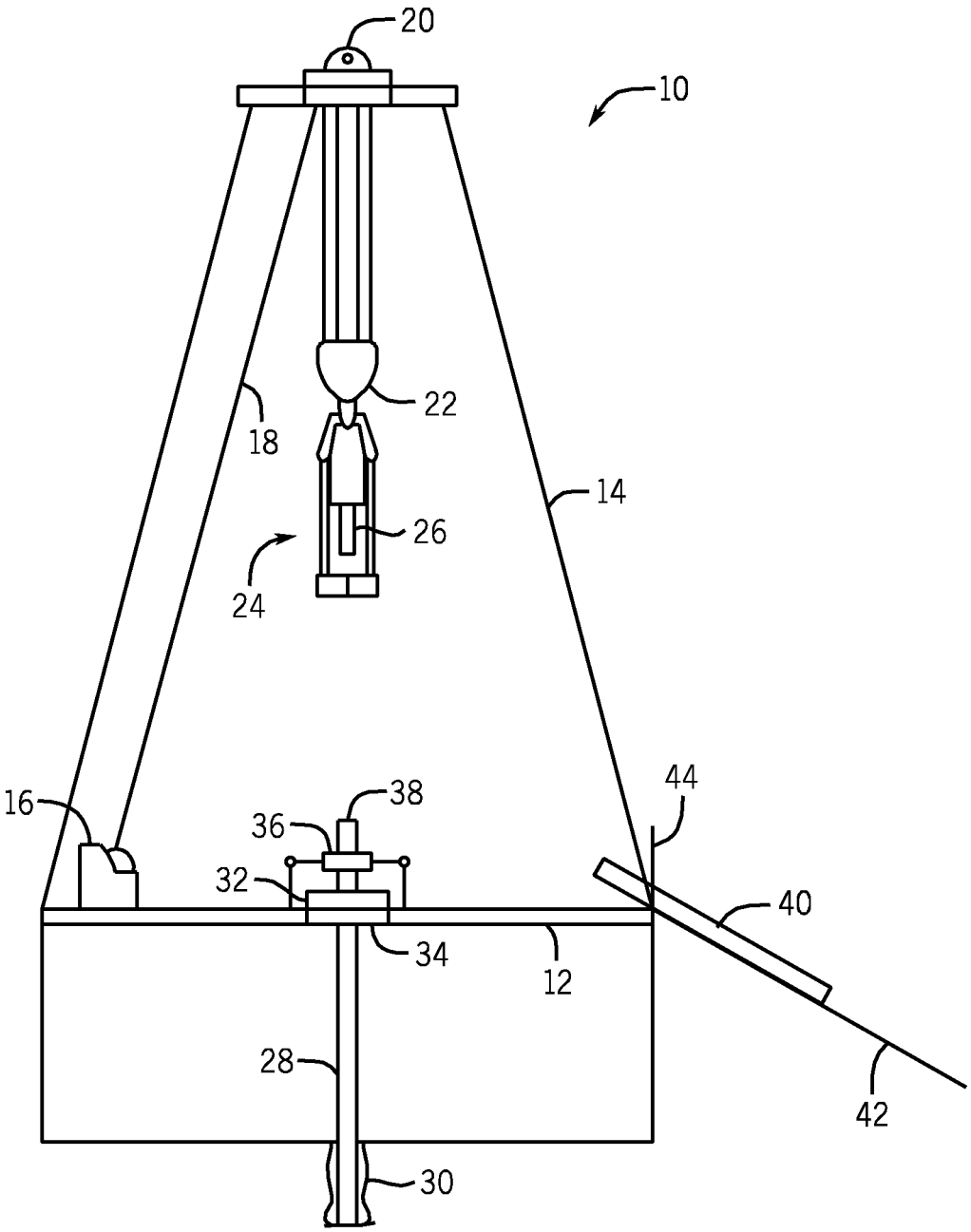
FIG. 1 is a schematic representation of a well being drilled in accordance with an embodiment of the present techniques.

Turning now to the drawings, FIG. 1 is a schematic representation of a drilling rig 10 in the process of drilling a well. The drilling rig 10 features an elevated rig floor 12 and a derrick 14 extending above the elevated rig floor 12. A supply reel 16 supplies drilling line 18 to a crown block 20 and traveling block 22 in order to hoist various types of drilling equipment above the rig floor 12. The traveling block 22 supports a swivel assembly 24, which features an engagement feature 26 used to engage tubular or other drilling equipment. Below the rig floor 12, a tubular string 28 extends downward into a wellbore 30 and is held stationary with respect to the rig floor 12 by a spider or power slips 32 of a rotary table 34. In some embodiments, power tongs 36 may be located above the rig floor 12 to apply a torque for making up new lengths of tubular. A portion of the tubular string 28 extends above the rig floor 12, forming a stump 38 to which another tubular element 40 (e.g., a joint of drillpipe) may be added.

In present embodiments, the swivel assembly 24 is configured to operate on drilling rigs 10 equipped with a Kelly drive. That is, the drilling rig 10 may utilize the rotary table 34 to impart a torque on the tubular string 28 to run the tubular string 28 into the wellbore 30. The Kelly drive may include a pipe with a polygonal outer surface (not shown) that engages the tubular string 28. This pipe may pass through a similarly shaped bushing that is rotated by the rotary table 34. As the rotary table 34 rotates the tubular string 28 in this way, the swivel assembly 24 is engaged with the tubular string 28 (via the engagement feature 26) to support the tubular string 28. The engagement feature 26 may be configured to rotate freely with respect to the rest of the swivel assembly 24 as the tubular string 28 rotates. A new tubular element 40 may be brought to the rig floor 12 via a pipe ramp 42. The swivel assembly 24 may be lowered to a vee door 44 of the drilling rig 10, where the swivel assembly 24 engages the tubular element 40 using the engagement feature 26. In some embodiments, the engagement feature 26 may be actuated to grip and to provide a hydraulic seal to the tubular element 40. The tubular element 40 may be lifted from the vee door 44 via the swivel assembly 24 and lowered onto the stump 38 to make the next connection of the tubular string 28. This process of making up new lengths of tubular is described in greater detail below. The presently disclosed swivel assembly 24 may be appropriate for use on any drilling rig 10 equipped with a Kelly drive or other drive that rotates the tubular string 28 from the rig floor 12. In addition, the swivel assembly 24 may be applied to drilling rigs 10 of any relative size, including heavy or light duty rigs, workover rigs, servicing rigs, completion rigs, and so forth.

It should be noted that the drilling rig 10 illustrated in FIG. 1 is intentionally simplified to focus on the swivel assembly 24 and the engagement feature 26 described in the present disclosure. Many other components and tools may be employed during the various periods of formation and preparation of the wellbore 30. Similarly, the environment of the wellbore 30 may vary widely depending upon the location and situation of the formations of interest. For example, rather than a surface (land-based) operation, the wellbore 30 may be formed under water of various depths, in which case the topside equipment may include an anchored or floating platform.

Figure 2:
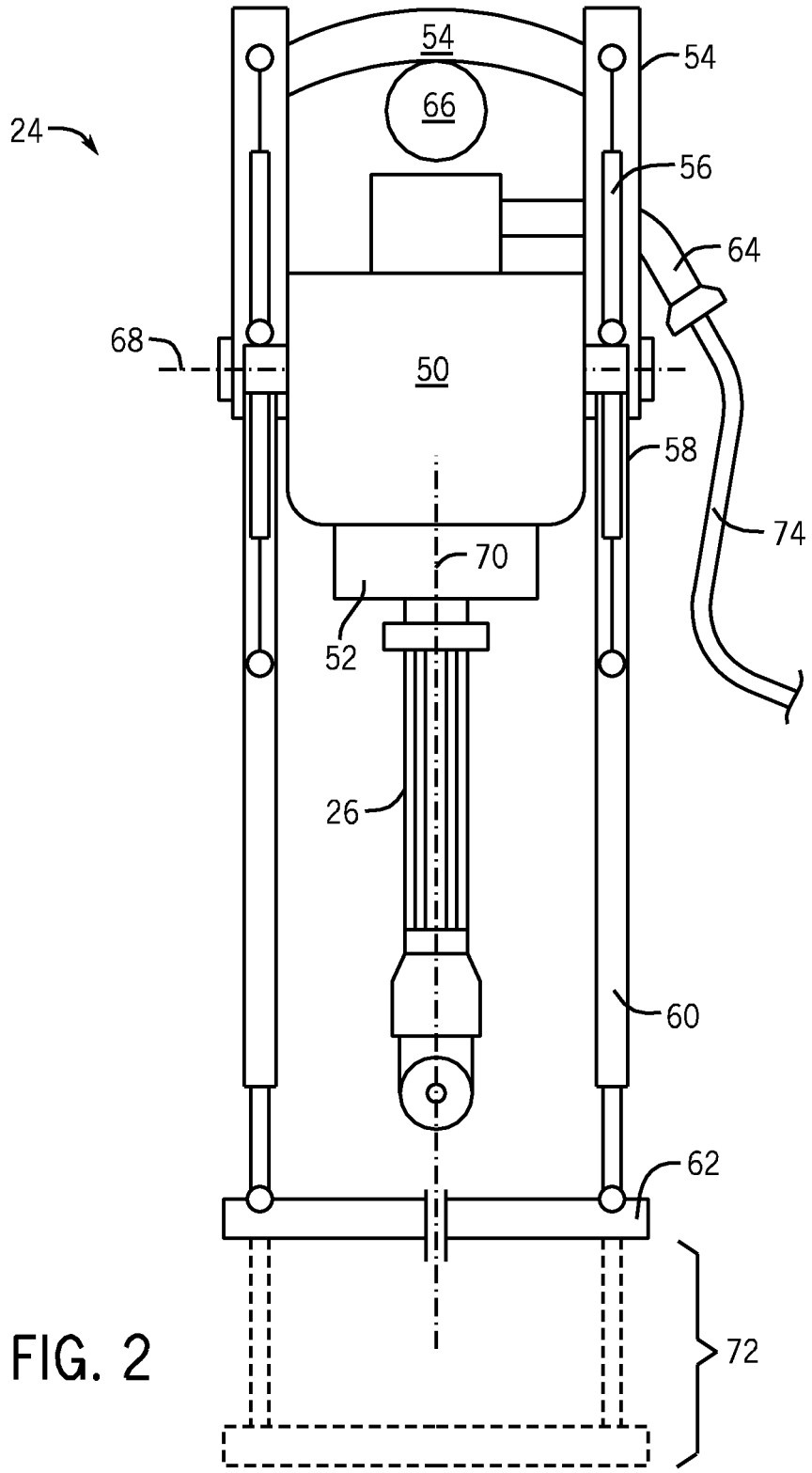
FIG. 2 is a front view of a swivel assembly for manipulating tubular about a drilling rig in accordance with an embodiment of the present techniques.

FIG. 2 is a front view of the swivel assembly 24 used to manipulate the tubular element 40 about the drilling rig 10. In the illustrated embodiment, the swivel assembly 24 includes a swivel body 50, the engagement feature 26, an actuator system 52, a becket 54, becket tilt rams 56, link tilt rams 58, elevator link rams 60, elevators 62, and a gooseneck 64. The becket 54 is designed to couple with the traveling block 22. In the illustrated embodiment, for example, the becket 54 rests on a hook 66 extending downward from the traveling block 22.

The swivel body 50 is rotatably coupled with the becket 54. More specifically, the swivel body 50 may be pinned to the becket 54 such that the swivel body 50 is configured to rotate about a first axis 68 of the swivel body 50 relative to the becket 54. It may be desirable for the first axis 68 to be located approximately along a center of gravity of the swivel assembly 24, to promote relatively stable rotation of the swivel body 50 relative to the becket 54. That is, the becket 54 may remain vertically oriented as it hangs from the hook 66 of the traveling block 22, even as the swivel body 50 and any attached mass is rotated relative to the becket 54. In some embodiments, counterweights may be added to the swivel body 50 at a position located relatively above the first axis 68 to maintain the center of gravity of the swivel assembly 24 along the first axis 68 when the swivel assembly 24 handles heavier tubular elements 40. In this way, the swivel assembly 24 may be adjustable for use with a variety of different sizes and types of tubular.

The engagement feature 26 is rotatably coupled with the swivel body 50. Specifically, the engagement feature 26 may be configured to rotate about a second axis 70 of the swivel body 50 that is substantially transverse to the first axis 68. Once a new tubular is added to the tubular string 28 via the swivel assembly 24, the weight of the tubular string 28 may be supported by the swivel assembly 24. As the rotary table 34 rotates the tubular sting 28 (e.g., to advance the well), the engagement feature 26 may rotate relative to the swivel body 50 as the tubular string 28 is rotated.

The becket tilt rams 56 include hydraulically actuated rams coupled between the becket 54 and the swivel body 50. These becket tilt rams 56 may function as a tilt mechanism for rotating the swivel body 50 and the engagement feature 26 relative to the becket 54. More specifically, the becket tilt rams 56 may be actuated to transition the swivel body 50 and the engagement feature 26 between a tilted orientation and an upright orientation relative to the becket 54. Although the tilt mechanism includes becket tilt rams 56 in the illustrated embodiment, other mechanisms for tilting the swivel body 50 and the engagement feature 26 relative to the becket 54 may be possible.

As noted above, the swivel assembly 24 may be equipped with elevators 62 in some embodiments. In the illustrated embodiment, the elevators 62 are coupled to the swivel body 50 via the elevator link rams 60. The elevator link rams 60 may be hydraulically actuated to extend the elevators 62 toward the tubular element 40, or another piece of drilling equipment to be grasped. The elevator link rams 60 may be configured to extend the elevators 62 a maximum distance 72 of approximately five feet in some embodiments. The elevators 62 may include dog collar slip type elevators, single joint elevators, or any other desirable type of elevators 62 for pulling the tubular element 40 toward the engagement feature 26. The elevator link rams 60 may be rotatably coupled to the swivel body 50. Specifically, the elevator link rams 60 may be pinned to the swivel body 50 along the first axis 68, and may be rotated with respect to the swivel body 50 via the link tilt rams 58. The link tilt rams 58 may be hydraulic rams coupled between the elevator link rams 60 and the swivel body 50 that, when actuated, tilt the elevator link rams 60 relative to the swivel body 50. Other embodiments may employ different types of tilt mechanisms to provide this rotation. Still further embodiments may not include the elevators 62 and related equipment at all.

The engagement feature 26 may include an internal engagement feature, as illustrated, or an external engagement feature. The internal engagement feature may be designed to apply a force to grip and engage with an inner portion of the tubular element 40. Such a feature may include a mandrel assembly having a grapple element, packer element, and/or a spear head assembly that may be actuated to provide this interior engagement. The external engagement feature may be designed to apply a force to grip and engage with an outer diameter of the tubular element 40. This may be particularly effective in engaging smaller diameter tubular. An example of an external engagement feature for use in the swivel assembly 24 is described below with reference to FIGS. 5-8.

The swivel assembly 24 is equipped with an actuator system 52 configured to actuate the engagement feature 26 and the becket tilt rams 56 as desired. In the illustrated embodiment, the actuator system 52 is designed to actuate the link tilt rams 58 and the elevator link rams 60 as well. The actuator system 52 may control a flow of hydraulic fluid to each set of rams and the engagement feature 26 as desired to control and synchronize actuation of these various components. The actuator system 52 may receive control signals from a control unit of the drilling rig 10. It should be noted that while a single "actuator system" is illustrated and discussed, the disclosed actuator system 52 may include any number of separate actuator components used to perform different functions. For example, the actuator system 52 may include four separate actuation components for actuating each of the engagement feature 26, the becket tilt rams 56, the link tilt rams 58, and the elevator link rams 60. The actuator system 52 may coordinate the functions performed by each actuation component via control signals from a control unit.

The gooseneck 64 may route fluid from a Kelly hose 74 into a conduit through the swivel body 50, facilitating a flow of the fluid through the swivel assembly 24. A hydraulic unit located near the rig floor 12 of the drilling rig 10 may pump the fluid through the swivel assembly 24 and into the attached tubular string 28. The fluid may include displacement fluid and the swivel assembly or system 24 may be utilized with such fluid to expel cement slurry from a casing string and into an annulus of the wellbore. That is, the swivel system 24 may facilitate flow of the displacement fluid into the tubular string 28 to displace resident cement slurry with the displacement fluid. In another embodiment, the fluid may include completion fluid (e.g., a liquid that is generally solids-free and that is used to complete a well). Indeed, the swivel system 24 may be used to properly place the completion fluid for control of the well. In some embodiments, pumping of the fluid through the swivel assembly into the tubular string 28 may occur as the tubular string 28 is used to advance the well, wherein the fluid is drilling fluid. In such an embodiment, the drilling fluid flows down through the tubular string 28 and, upon exiting the tubular string 28, washes cuttings away from a drill bit at the bottom of the wellbore 30. In various fluid flow operations, the fluid flow may be referred to as circulation, since the fluid eventually returns, through the annulus of the wellbore 30, to a fluid tank at the surface. Therefore, the disclosed swivel assembly 24 may allow circulation of fluid as a component of certain operations (e.g., advancing the tubular string 28 using a Kelly drive and bushing). In some embodiments, cement may be routed through the Kelly hose 74, the gooseneck 64, and the swivel assembly 24 when the swivel assembly 24 is reciprocating tubular in the wellbore 30. It should also be noted that present embodiments may be utilized in casing running and reaming applications.

Figure 3:
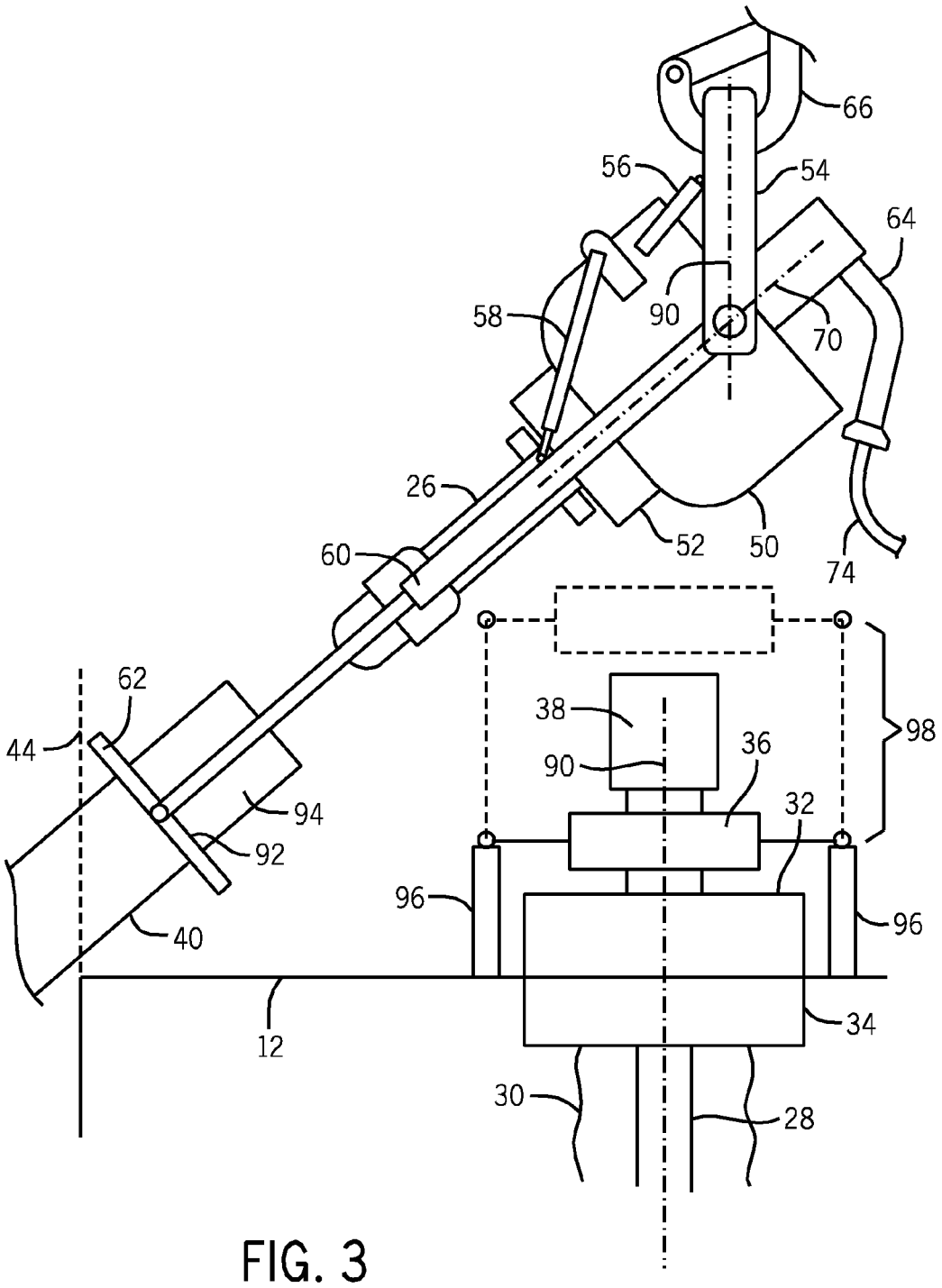
FIG. 3 is a side view of the swivel assembly of FIG. 2 and power tongs for making up tubular in accordance with an embodiment of the present techniques.

FIG. 3 is a side view of the swivel system 24 used in combination with the power tongs 36 to make up tubular on the drilling rig 10. Again, the swivel assembly 24 may be used to grab the tubular element 40 from a tilted position substantially near the vee door 44 of the drilling rig 10. The swivel assembly 24 may then lift the tubular element 40 from the vee door 44, position the tubular element 40 above the stump 38 of the tubular string 28, and lower the tubular element 40 toward the stump 38. The power tongs 36 may connect the tubular element 40 with the stump 38, thereby adding a new length to the tubular string 28.

The swivel assembly 24 may retrieve the tubular element 40 from an inclined position proximate the vee door 44 of the drilling rig 10. The actuation system 52 may actuate the becket tilt rams 56 to angle the swivel body 50 and the engagement feature 26 appropriately for picking up the tubular element 40. That is, the becket tilt rams 56 may be configured to contract to achieve a tilted orientation of the swivel body 50 and the engagement feature 26 relative to the becket 54. Similarly, the becket tilt rams 56 may be configured to expand to achieve an upright orientation of these components. The illustrated embodiment shows the swivel assembly in this tilted orientation, as the second axis 70 of the swivel body 50 and the engagement feature 26 is tilted relative to a vertical axis 90 of the becket 54 and the tubular string 28. The becket tilt rams 56 may be contracted until the second axis 70 matches or nearly matches the orientation of the tubular element 40, which may be the same as the orientation of the pipe ramp 42.

The elevators 62 may be coupled to the swivel body 50 via the elevator link rams 60, and may be used to bring the tubular element 40 into contact with the engagement feature 26. The elevator link rams 60 may rotate with the swivel body 50 without actuation of the link tilt rams 58. The actuator system 52 may actuate the elevator link rams 60 to extend the elevators 62 toward the tubular element 40. The elevators 62 may be ratchet action elevators, such that the elevators 62 slide down the tubular element 40 until they catch on a lip 92 of the tubular element 40. The lip 92 may function as an abutment surface at an upper end 94 of the tubular element 40, and the ratchet action elevators 62 may close over the slightly lower diameter section beneath the lip 92 of the tubular element 40. The elevators 62 may be retracted toward the swivel body 50 via the elevator link rams 60 to bring the tubular element 40 into contact with the engagement feature 26. The engagement feature 26 may then be actuated to engage the tubular element 40. Thus, the actuation of the elevator link rams 60 may facilitate securing the tubular element 40 with the engagement feature 26. As a result, the swivel assembly 24 may be able to retrieve the tubular element 40 from the vee door 44 with limited human intervention to make the connection. In some embodiments, the swivel assembly 24 may be capable of engaging the tubular element 40 without an operator physically tilting and positioning the elevators 62 over the tubular element 40. This reduced direct handling of the drilling equipment may improve efficiency of rig operations and free operators to perform other functions on the drilling rig 10.

After the engagement feature 26 engages the tubular element 40, the swivel assembly 24 may be hoisted via the traveling block 22 to position a bottom portion of the tubular element 40 near the stump 38 of the tubular string 28. In the illustrated embodiment, the power tongs 36 make up the tubular connection, although in other embodiments any desirable connection mechanism may be utilized. The power tongs 36 may be configured to receive the tubular element 40 while the tubular element 40 is engaged with the engagement feature 26. The power tongs 36 may then mate the engaged tubular element 40 with the tubular string 28. As noted above, the engagement feature 26, which is rotatably coupled with the swivel body 50, may rotate relative to the swivel body 50 along with the tubular element 40 as the connection is made.

The power tongs 36 may apply a torque and rotation to make the connection between the tubular element 40 and the stump 38. To make this connection, the power tongs 36 may be positioned at an elevated location via tong head raising cylinders 96 that support the power tongs 36. In some embodiments, the cylinders 96 may raise the head of the power tongs 36 by a certain distance 98 (e.g., approximately 20 inches) to position the head of the power tongs 36 above the stump 38. The torque provided by the power tongs 36 may be applied just above (or just below) the tubular connection. The power tongs 36 may be powered hydraulically using an engine directly coupled with a pump or an electric motor directly coupled to a pump. The power tongs 36 may convert electrical power into the force needed to make the connection. Thus, the power tongs 36 may apply the torque to make the connection without the use of cables or other tension members.

Figure 4:
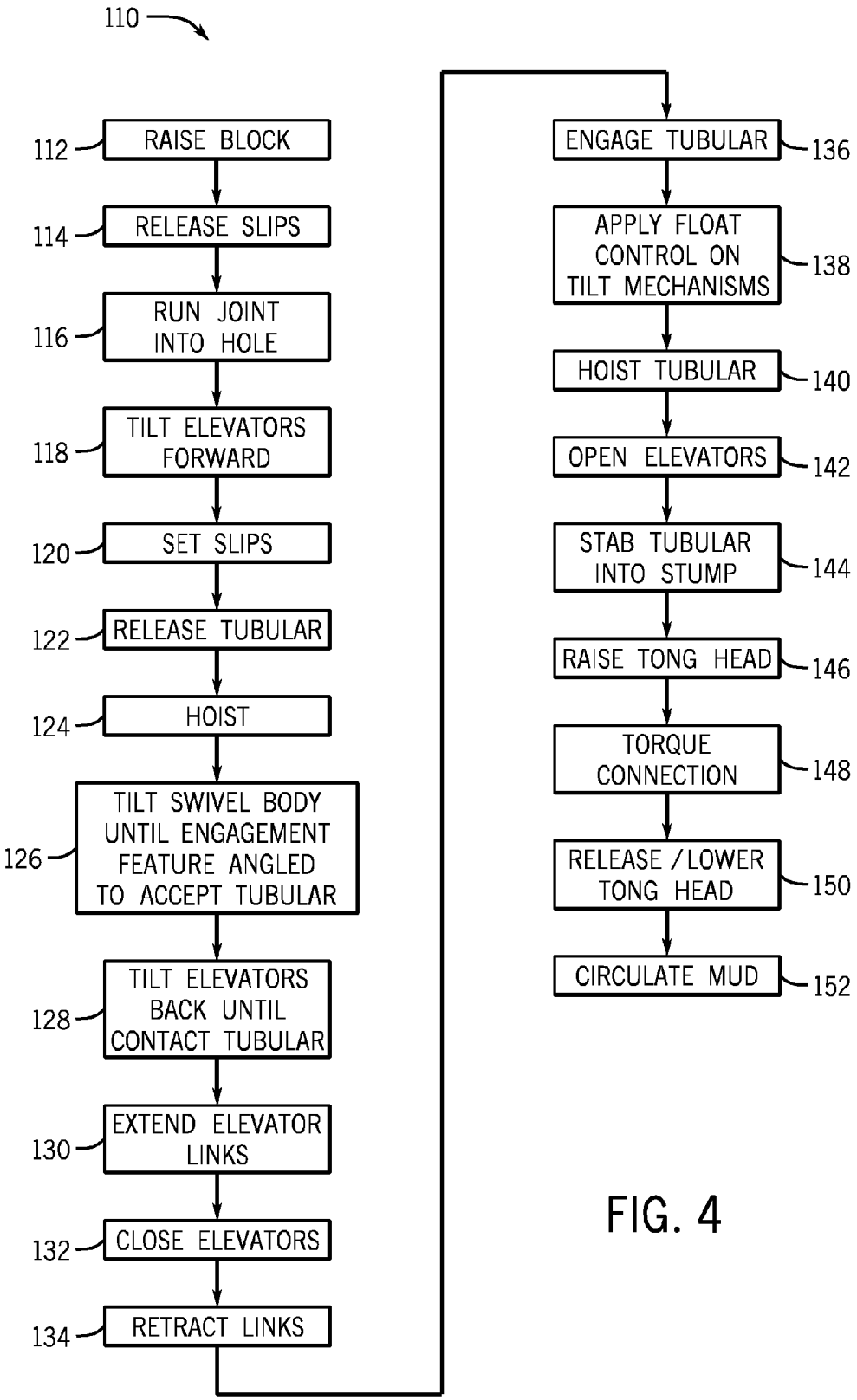
FIG. 4 is a process flow diagram of a method for making up tubular using the swivel assembly and power tongs of FIG. 3 in accordance with an embodiment of the present techniques.

Having discussed the various rig components that may be used to manipulate and connect tubular, a detailed discussion of specific steps for utilizing such components in combination to make up tubular will be provided. To that end, FIG. 4 is a process flow diagram of a method 110 for making up tubular using the swivel assembly 24 and the power tongs 36. It should be noted that in some embodiments steps of the method 110 may be performed in different orders than those shown, or omitted altogether. In addition, some of the blocks illustrated may be performed in combination with each other. In the illustrated embodiment, the method 110 begins after connecting a length of tubular to the tubular string 28 extending into the wellbore 30.

The method 110 includes raising (block 112) the traveling block 22, releasing (block 114) the slips 32 that were previously supporting the weight of the tubular string 28, and running (block 116) the joint into the wellbore 30. At this point the swivel assembly 24 is supporting the weight of the tubular string 28. The method 110 also includes actuating the link tilt rams 58 to tilt (block 118) the elevator link rams 60 and the elevators 62 forward. This helps to move the elevators 62 out of the way of the stump 38 when running the joint of tubular into the wellbore 30. In addition, the method 110 includes setting (block 120) the slips 32 to hold the weight of the tubular string 28, releasing (block 122) the tubular string 28 from the swivel assembly 24 by disengaging the engagement feature 26, and hoisting (block 124) the swivel assembly 24 via the traveling block 22 until the engagement feature 26 is clear of the stump 38. From this position, the swivel assembly 24 may be prepared to retrieve and add a new length of tubular to the tubular string 28.

The method 110 may include tilting (block 126) the swivel body 50 until the engagement feature 26 is angled to accept the tubular element 40 from the vee door 44, or another position of the drilling rig 10. As described above, this tilting may be accomplished by actuating the becket tilt rams 56 to rotate the swivel body 50 and the engagement feature 26 into the desired tilted orientation. The becket 54 may remain stable in a substantially upright vertical orientation (e.g., within 5 degrees of the axis 90) as the swivel body 50 rotates about the first axis 68 (e.g., along a center of gravity of the swivel assembly 24). The method also may include tilting (block 128) the elevators 62 back until they contact the tubular element 40. This may specifically involve actuating (e.g., extending) the link tilt rams 58 to rotate the elevator link rams 60 with respect to the swivel body 50 until the elevators 62 reach the tubular element 40. Once the elevators 62 are positioned this way, the method 110 may include extending (block 130) the elevator links by actuating the elevator link rams 60. As noted above, the elevators 62 may slide down an outer surface of the tubular element 40 from the upper end 94 downward. After passing the lip 92, or some other abutment surface of the tubular element 40, the method 110 includes closing (block 132) the elevators 62 and retracting (block 134) the elevator links by contracting the elevator link rams 60. With the tubular element 40 held securely within the elevators 62, the elevator link rams 60 may pull the elevators 62, and the tubular element 40, toward and eventually into contact with the engagement feature 26. The method 110 includes engaging (block 136) the tubular element 40. This step may be performed in conjunction with retracting the elevators 62 in some embodiments. The swivel assembly 24 may allow the tubular element 40 to be pulled into engagement with the swivel assembly 24 while it is tilted. Thus, the tubular element 40 may be engaged with the swivel assembly 24 as it is pulled out from the vee door 44.

Upon engagement of the tubular element 40, the method 110 may include applying (block 138) a float control of the various tilt mechanisms in use on the swivel assembly 24. The float control scheme may unload the hydraulic force in the cylinders of the becket tilt rams 56 and the link tilt rams 58. At the same time, or after applying the float control, the tubular element 40 may be hoisted (block 140) upward by the traveling block 22. As a result, the swivel body 50, the engagement feature 26, and the elevator link rams 60 may gradually align with the vertical axis 90 as the tubular element 40 is lifted from its inclined position at the vee door 44. The method 110 further includes opening (block 142) the elevators 62. This step can be performed at any point once the tubular element 40 is fully engaged by the engagement feature 26. In some instances, such as when the tubular element 40 is relatively small, it may be beneficial to open the elevators 62 sooner rather than later, to maintain the integrity of the outer portion of the tubular element 40 being hoisted.

After hoisting the tubular element 40, the tubular element 40 may be connected to the rest of the tubular string 28. To that end, the method 110 includes stabbing (block 144) the tubular element 40 into the stump 38 of the tubular string 28. Before this step, the tubular element 40 may be hoisted to a position of approximately six to eight inches above the stump 38. The method 110 then includes raising (block 146) the tong head of the power tongs 36 until it is even with the lower end of the tubular element 40 and applying a torque connection (block 148) via the power tongs 36. As noted above, raising the tong head may involve actuating the cylinders 96. The torque applied by the power tongs 36 may screw the tubular element 40 into the tubular string 28. Although the tong heads described in the present method 110 are power tong heads that automatically convert electrical energy into the mechanical force needed to make the connection, other embodiments may utilize manual tong heads, a Kelly spinner, or any other method for applying the appropriate torque to the tubular element 40. Once the connection is made, the method 110 includes releasing and lowering (block 150) the tong head of the power tongs 36 back toward the slips 32. If desired, it may be appropriate to circulate (block 152) mud through the swivel assembly 24 and down through the tubular string 28. From here, the sequence may be repeated.

Figure 5:
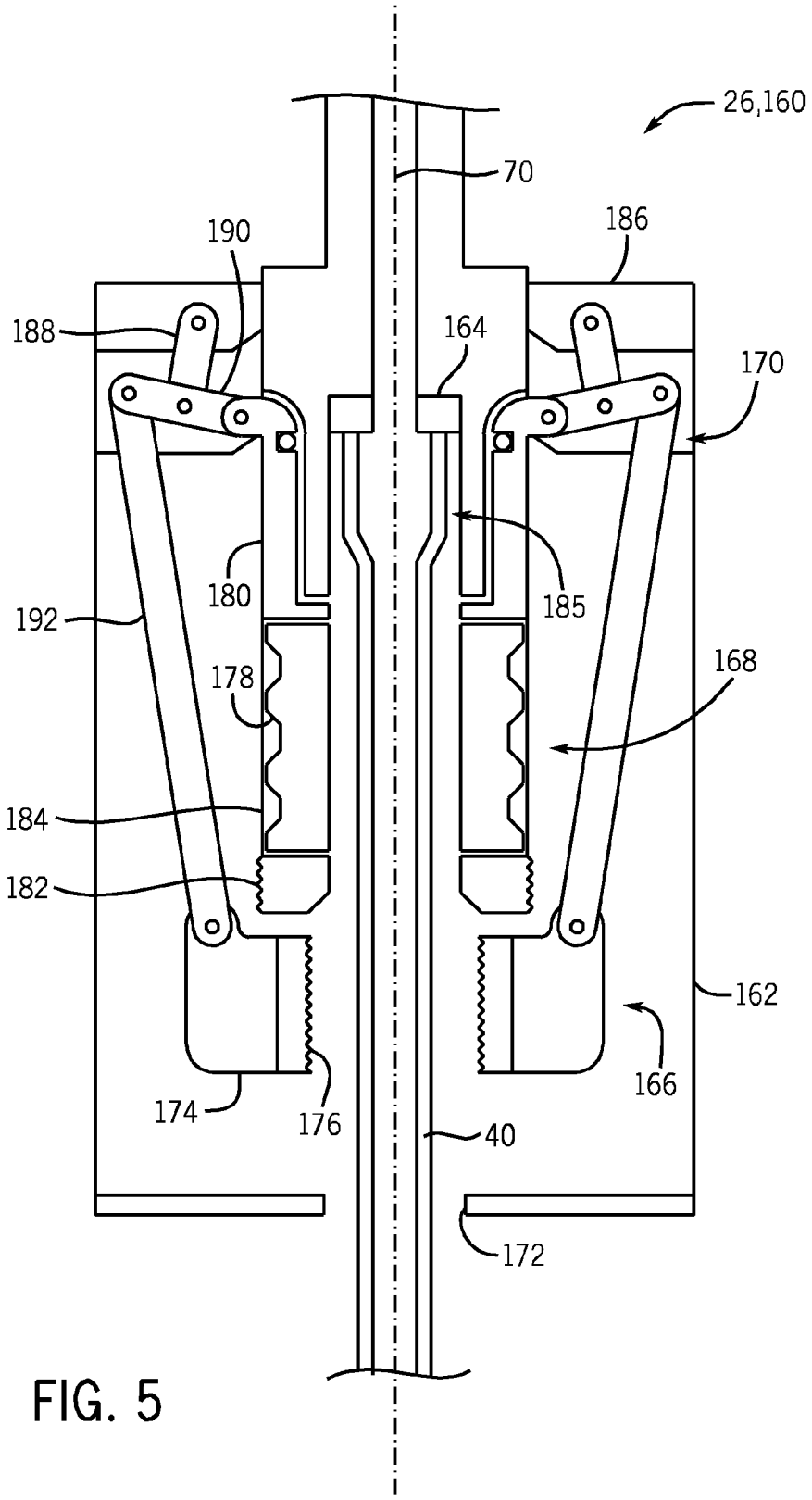
FIG. 5 is a cross-sectional view of an external engagement feature in accordance with an embodiment of the present techniques.

In the embodiments shown in FIGS. 1-3, the engagement feature 26 of the swivel assembly 24 includes an internal assembly that uses a mandrel to engage an inner surface of the tubular element 40. However, in other embodiments it may be desirable to engage an outer surface of the tubular element 40. For example, it may be desirable for the engagement feature 26 to engage tubular elements 40 with a relatively small outer diameter (e.g., approximately 3.5 inches or less). Such tubular may be too small for an internal engagement mechanism. FIG. 5 is a cross-sectional view of an external engagement feature 160 that may be used to grip and seal an outer diameter of the tubular element 40. The external engagement feature 160 may include a housing 162, a seat 164, a gripping mechanism 166, a sealing mechanism 168, and a mechanical assembly 170.

In the illustrated embodiment, the external engagement feature 160 is an entirely mechanical assembly, able to operate without sending control signals between the components of the engagement feature 160. As described below, the movement of one hydraulic device may produce a mechanical hold via the gripping mechanism 166 and may energize the sealing mechanism 168 without the use of a sequence control valve. The external engagement feature 160 described herein may be capable of both gripping and sealing the tubular element 40 by contacting only external portions of the tubular element 40.

The external engagement feature 160 may be enclosed within the housing 162. As noted above, the tubular element 40 may be brought toward the engagement feature 26 via a separate component (e.g., elevators 62). In other embodiments, the engagement feature 26 may be lowered onto the tubular element 40 from above. In either instance, the tubular element 40 may enter the external engagement feature 160 via an opening 172 and pass through the external engagement feature 160 until it contacts the seat 164. Thus, the seat 164, which is part of the housing 162, may receive a distal end of the tubular element 40, as shown.

In the illustrated embodiment, the gripping mechanism 166 includes a die segment 174 configured to be actuated to grip an external surface of the tubular element 40. The die segment 174 may include teeth 176 for gripping the external surface, and this gripping connection may be used to transfer torque between the tubular element 40 and the external engagement feature 160. The sealing mechanism 168 may be positioned between the seat 164 and the gripping mechanism 166. As illustrated, the sealing mechanism 168 may include a rubber component 178 disposed between a push collar 180, a nut 182, and a wall 184 of the housing 162. The sealing mechanism 168 may be positioned such that a box end 185 of the tubular element 40, once inserted into the external engagement feature 160 so that it contacts the seat 164, is located above the rubber component 178. The rubber component 178 may include a commercially available well servicing stripper rubber (e.g., TXJU stripper rubber).

The mechanical assembly 170 is coupled to the gripping mechanism 166 and to the sealing mechanism 168 and is configured to mechanically actuate the gripping mechanism 166 and the sealing mechanism 168. The mechanical assembly 170 may include two or more linkages for transferring force from an actuator component 186 of the external engagement feature 160. These two or more linkages may transfer a single force to the gripping mechanism 166 and to the sealing mechanism 168, the single force being a hydraulic force applied to the actuator component 186 (e.g., via the actuator system 52). In response to the single force applied to the actuator component 186, the mechanical assembly 170 may actuate both the gripping mechanism 166 and the sealing mechanism 168. In some embodiments, the actuation of the gripping mechanism 166 and the sealing mechanism 168 may be performed according to a desired sequence.

In the illustrated embodiment, the linkages of the mechanical assembly 170 include a relay linkage 188, an equalizer linkage 190, and a die linkage 192. The relay linkage 188 may be pinned between the actuator component 186 and a central position along the length of the equalizer linkage 190. The equalizer linkage 190 may be pinned at one end to the die linkage 192 and at the opposite end to the push collar 180, and at a central region to the relay linkage 188. The die linkage 192 may be pinned at one end to the equalizer linkage 190 and at an opposite end to the die segment 174. As illustrated, the external engagement feature 160 may include multiple (e.g., 2, 3, 4, 5, 6, or more) sets of these linkages at different circumferential positions of the external engagement feature 160. Other types of mechanical assemblies 170 may be employed to actuate the gripping mechanism 166 and the sealing mechanism 168 of the external engagement feature 160.

Figure 6:
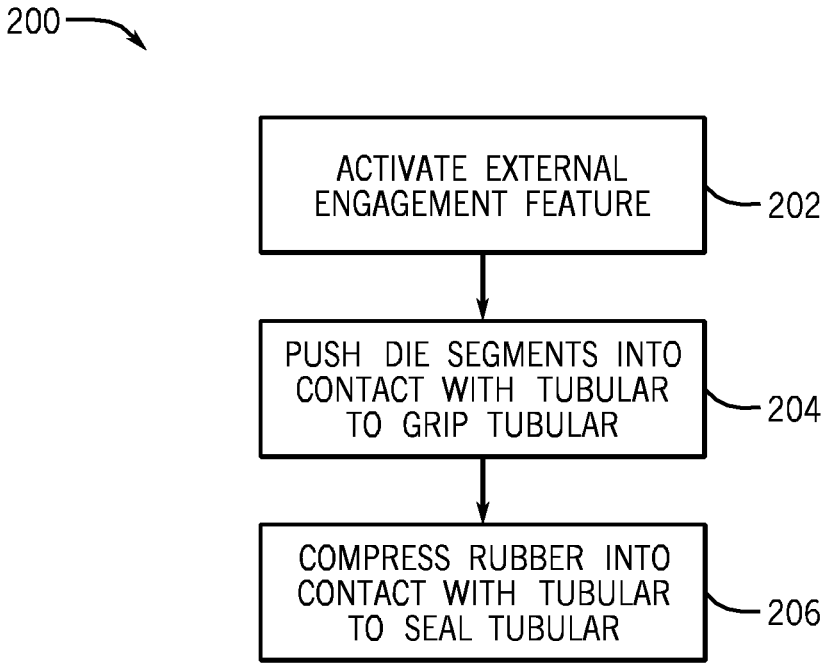
FIG. 6 is a process flow diagram of a method for engaging tubular using the external engagement feature of FIG. 5 in accordance with an embodiment of the present techniques.

As noted above, the mechanical assembly 170 may be configured to sequence activation of the gripping mechanism 166 and the sealing mechanism 168. As an example of this sequencing, FIG. 6 is a process flow diagram of a method 200 for engaging the tubular element 40 using the external engagement feature 160. The method 200 includes actuating (block 202) the external engagement feature 160. In an embodiment of the swivel assembly 24 described above with reference to FIGS. 1-3, this actuation may be performed by the actuator system 52 energizing the actuator component 186 from a disengaged position to an engaged position. The external engagement feature 160 illustrated in FIG. 5 shows the actuator component 186 in the disengaged position.

Figure 7:
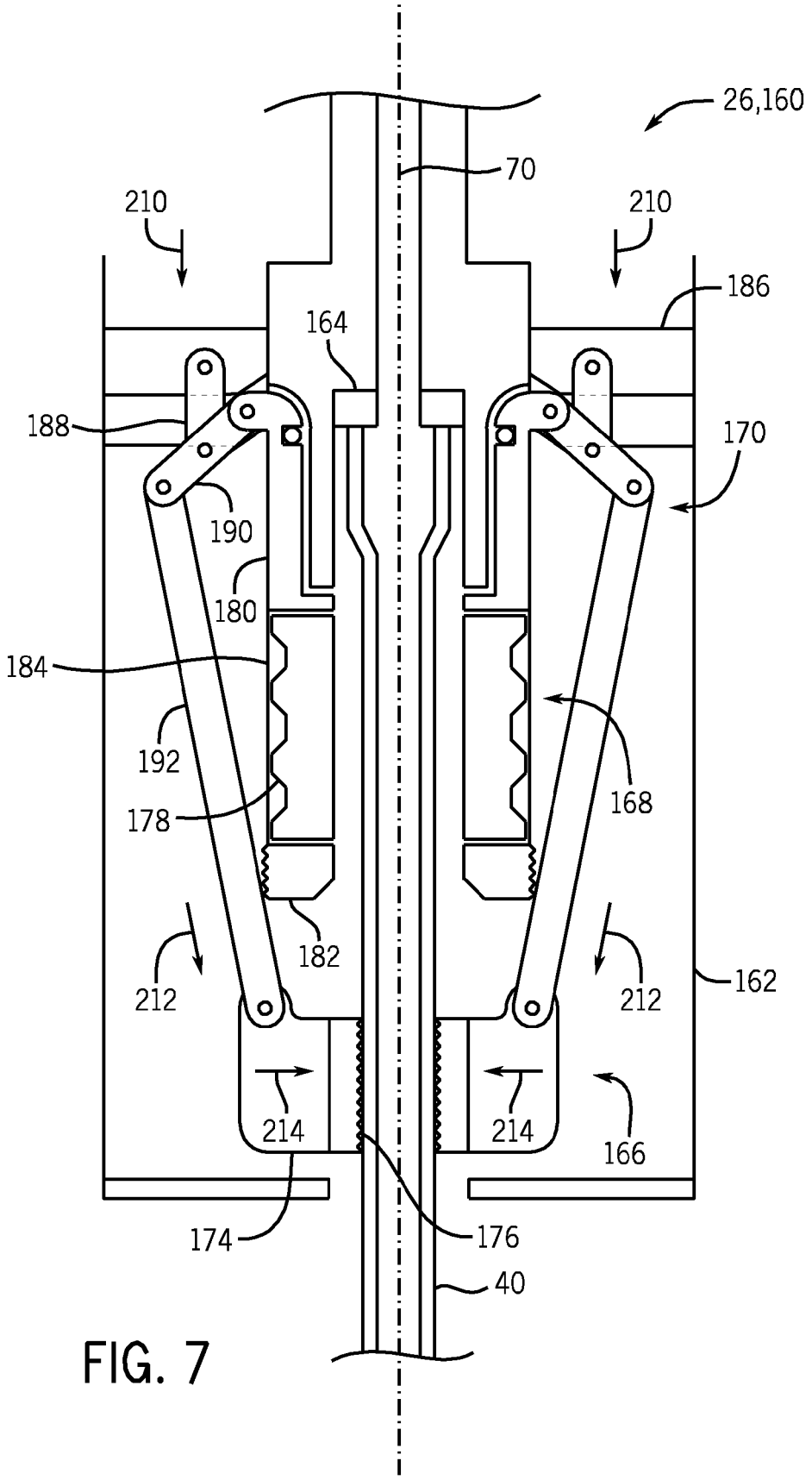
FIG. 7 is a cross-sectional view of the external engagement feature of FIG. 5 gripping a tubular in accordance with an embodiment of the present techniques.
Figure 8:
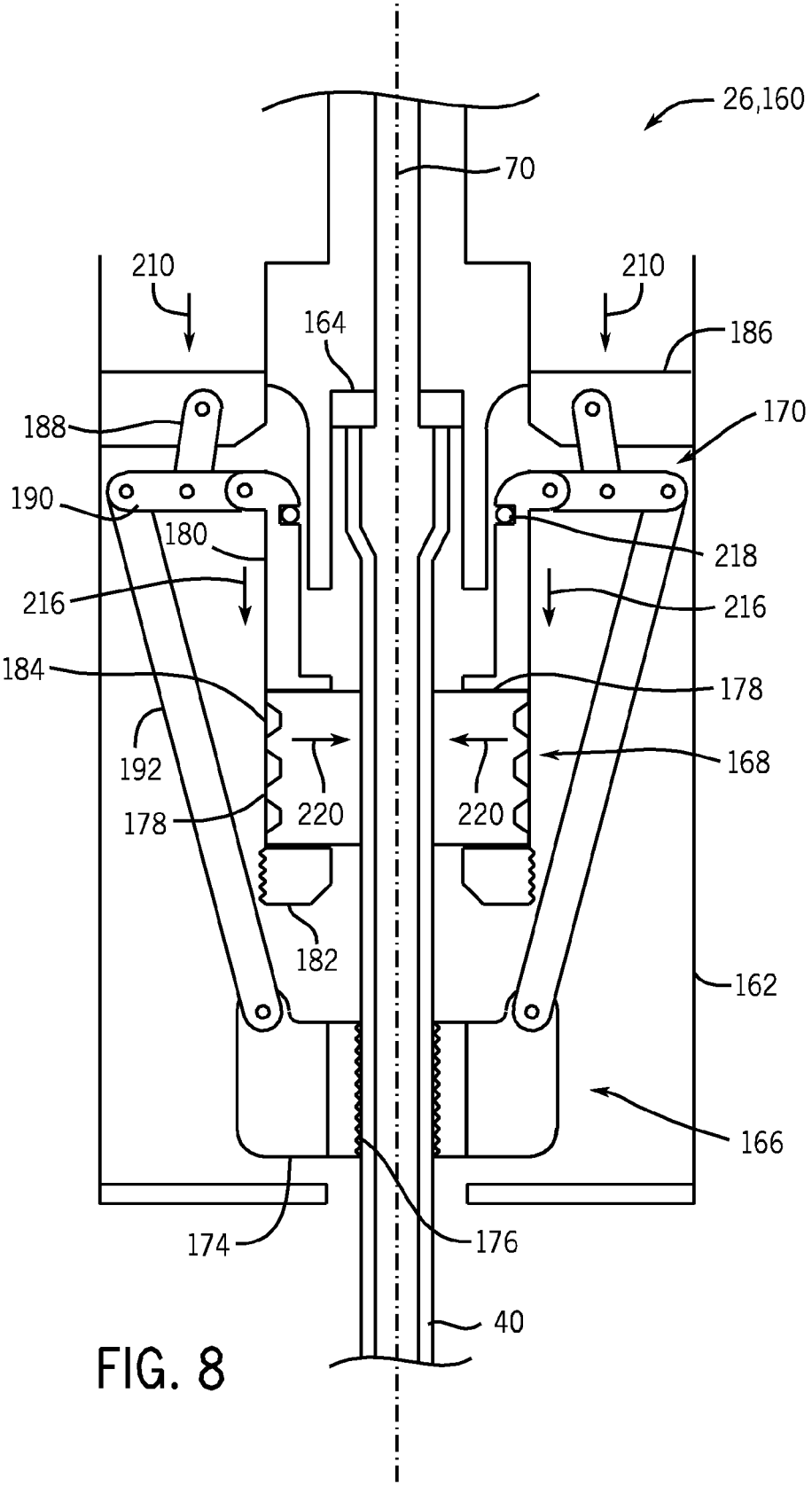
FIG. 8 is a cross-sectional view of the external engagement feature of FIGS. 5 and 7 sealing the tubular in accordance with an embodiment of the present techniques.

The method also includes pushing (block 204) the die segments 174 into contact with the tubular element 40 to grip the tubular element 40. This is shown in FIG. 7, where the actuator component 186 is lowered to a partially engaged position. In addition, the method includes compressing (block 206) the rubber component 178 into contact with the tubular element 40 to seal the tubular element 40. This is shown in FIG. 8, where the actuator component 186 is lowered to an entirely engaged position. Thus, the step of actuating (block 202) the external engagement feature 160 may facilitate a sequenced gripping and sealing of the tubular element 40.

FIG. 7 shows the external engagement feature 160 in the partially engaged position. A force applied to the actuator component 186, as represented by arrows 210, pushes the actuator component 186 downward, causing the linkages of the mechanical assembly 170 to move and transfer force. More specifically, the actuator component 186 pushes the relay linkage 188 downward, which moves the equalizer linkage 190 downward. This downward movement of the equalizer linkage 190 may move the push collar 180 and the die linkage 192 downward. The push collar 180 may contact the rubber component 178, which may decrease or stop the downward motion of the push collar 180. At this point the equalizer linkage 190 may rotate about the pinned connection between the equalizer linkage 190 and the push collar 180, thereby pushing the die linkage 192 downward and toward the tubular element 40, as shown by arrows 212. This diagonal movement of the die linkage 192 may force the die segments 174 downward and toward the tubular element 40. Once the die segments 174 contact the tubular element 40, a portion of the force from the actuator component 186 may push the die segment 174 into gripping contact with the tubular element 40 (e.g., via teeth 176) as illustrated by arrows 214. Once this contact is established, the die segment 174 becomes a fixed point relative to the mechanical assembly 170.

FIG. 8 shows the external engagement feature 160 in the fully engaged position. After the die segment 174 becomes a fixed point, the force applied to the actuator component 186, represented by the arrows 210, continues to push the relay linkage 188 downward. This downward force may cause the relay linkage 188 and the equalizer linkage 190 to rotate about the now fixed die linkage 192, forcing the push collar 180 downward, as shown by arrows 216. A push collar sealing element 218 may keep the push collar 180 from rotating in response to the force imparted by the equalizer linkage 190. This push collar sealing element 218 may include a ring that extends through each of the push collars 180 in the external engagement feature 160. The remaining downward travel of the push collar 180 may be used by the compliance of the rubber component 178. The rubber component 178, being caught between the wall 184, the nut 182, and the downward moving push collar 180, may be compressed. This compression of the rubber component 178 by the mechanical assembly 170 may cause deformation of the rubber component 178 toward a center of the housing 162, as shown by arrows 220. This brings the rubber component 178 into contact with an external diameter of the tubular element 40, sealing the tubular element 40.

In the illustrated embodiment, the same downward force (shown by the arrows 210) actuates both the gripping mechanism 166 and the sealing mechanism 168. In addition, the mechanical assembly 170 of the various linkages allows the actuation of these components to be automatically sequenced. That is, the gripping mechanism 166 is applied first, followed by the sealing mechanism 168. When the external engagement feature 160 is released, or unloaded, the sequence outlined in the method 200 and illustrated in FIGS. 7 and 8 is reversed. That is, the actuator component 186 moves upward, releasing the sealing mechanism 168 first, followed by the gripping mechanism 166.

As the sequence is repeated and the external engagement feature 160 is used to engage with and then subsequently disengage with tubular elements 40, the rubber component 178 may become worn. As the rubber component 178 becomes worn, the slack in the rubber component 178 may be taken up via an adjustment of the nut 182. That is, the nut 182 may be tightened so that the rubber component 178 may be compressed within a smaller space. It should be noted that, as illustrated, the rubber component 178 may include a number of gaps around its outer perimeter (e.g., facing the wall 184). Such gaps may facilitate a desired amount of compression of the rubber component 178 in response to the force applied via the actuator component 186. The gaps may also function to effectively grip the wall 184 along portions of the side (but not the entire side) of the rubber component 178 facing the wall 184. This may decrease an amount of friction between the rubber component 178 and the wall 184 as the rubber component 178 is compressed into engagement with the tubular element 40.

The external engagement feature 160 described above with relation to FIGS. 5-8 may allow circulation of the tubular string 28 at any time during running or pulling operations. This would not be possible using an external engagement feature that only grips the tubular element 40 disposed therein in a manner merely sufficient for imparting motion and not for causing a seal. The presently disclosed external engagement feature 160 provides such a seal against internal pressure of fluid being circulated through the tubular string 28, in addition to the grip used to transfer rotation. That is, the external engagement feature 160 may allow for highly pressurized drilling fluid to be pumped through the tubular string 28 while the tubular string 28 is being rotated. Due to the gripping mechanism 166 holding the tubular element 40, there is no relative motion between the tubular element 40 and the sealing mechanism 168 as the tubular element 40 rotates. In addition, the external engagement feature 160 does not put any mark on the inside of the tubular element 40 and allows a larger fluid course for the drilling fluid circulated through the tubular string 28. This may be particularly effective when the external engagement feature 160 is used with smaller diameter tubular, where the fluid course may have a relatively small cross-sectional area.

The disclosed embodiments discussed above, including the swivel assembly 24 and the external engagement feature 160, may be utilized together or separately to improve operations on any type of drilling rig 10 using any desired size of tubular element 40. That is, the swivel assembly 24 may extend certain tubular manipulation functions to drilling rigs equipped with a Kelly drive, in addition to various service rigs, workover rigs, and completions rigs. The external engagement feature 160 may be utilized on these smaller rigs as well, and in some cases may be used as the engagement feature 26 of the swivel assembly 24. In addition, the external engagement feature 160 may facilitate gripping and sealing the outer diameter of tubular on any type of rig, including those drilling rigs equipped with top drives. Thus, the swivel assembly 24 and the external engagement feature 160 may increase tubular handling abilities on drilling rigs 10 of all types and sizes.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for manipulating a tubular about a drilling rig, comprising:

a swivel body rotatably coupled with a becket, wherein the becket is configured to couple with a traveling block of the drilling rig;

an engagement feature rotatably coupled with the swivel body, wherein the engagement feature is configured to be actuated to engage the tubular;

a tilt mechanism configured to be actuated to transition the swivel body and the engagement feature between a tilted orientation and an upright orientation relative to the becket;

an actuator system configured to actuate the tilt mechanism and the engagement feature;

elevators coupled to the swivel body via elevator links, wherein the actuator system is configured to actuate the elevator links to move the tubular into contact with the engagement feature and thus facilitate securing the tubular with the engagement feature; and an elevator tilt mechanism configured to tilt the elevator links with respect to the swivel body, wherein the actuator system is configured to actuate the elevator tilt mechanism, wherein the swivel body is rotatably pinned to the becket approximately at a center of gravity of the swivel body.

2. The system of claim 1, wherein the swivel body is rotatably coupled with the becket such that the swivel body is configured to rotate about a first axis of the swivel body relative to the becket, and wherein the engagement feature is rotatably coupled with the swivel body such that the engagement feature is configured to rotate about a second axis of the swivel body that is substantially transverse to the first axis.

3. The system of claim 1, comprising power tongs configured to receive the tubular while engaged with the engagement feature and configured to apply a torque to the tubular to mate the engaged tubular with a tubular string extending into a wellbore, wherein the engagement feature rotatably coupled with the swivel body is configured to rotate relative to the swivel body along with the tubular.

4. The system of claim 1, wherein the engagement feature comprises an internal assembly configured to engage an inner surface of the tubular or the engagement feature comprises an external assembly configured to engage an outer surface of the tubular.

5. The system of claim 1, wherein the tilt mechanism is coupled with the becket and the swivel body and is configured to contract to achieve the tilted orientation or expand to achieve the upright orientation.

6. The system of claim 1, wherein the actuator system comprises two or more actuator components, wherein each of the actuator components performs functions in coordination based on signals received from a control unit.

7. A method for manipulating a tubular about a drilling rig, comprising:

tilting, via a tilt mechanism, a swivel body and an engagement feature from an upright orientation to a tilted orientation relative to a becket, wherein the swivel body is rotatably coupled with the becket approximately at a center of gravity of the swivel body, and wherein the engagement feature is rotatably coupled with the swivel body;

extending elevator links to move elevators relative to the tubular, closing the elevators about the tubular, and retracting the elevator links to pull the tubular into contact with the engagement feature, wherein the elevator links are rotatable coupled to the swivel body;

engaging the tubular via the engagement feature; and actuating the tilt mechanism and the engagement feature via an actuator system.

8. The method of claim 7, comprising tilting the swivel body and the engagement feature relative to the becket until the engagement feature is angled to accept the tubular.

9. The method of claim 7, comprising actuating, via the actuator system, the elevator links and the elevators.

10. The method of claim 7, comprising tilting the swivel body and the engagement feature from the tilted position to the upright position by:

unloading, via the actuator system, hydraulic rams of the tilt mechanism; and hoisting the swivel body via a traveling block, wherein the becket hangs from the traveling block.

11. The method of claim 7, comprising:

stabbing, via the engagement feature, the tubular into a stump of a tubular string, wherein the tubular string extends into a wellbore; and coupling the tubular to the stump by applying a torque connection via power tongs.

* * * * *